United States Patent [19]

Bassett

[11] 4,181,296

[45] Jan. 1, 1980

[54] BENCH VISE

[76] Inventor: Alvin L. Bassett, 2148 S.E. 135th St., Portland, Oreg. 97233

[21] Appl. No.: 916,741

[22] Filed: Jun. 19, 1978

[51] Int. Cl.[2] ..... B25B 1/22

[52] U.S. Cl. ..... 269/88; 269/91; 269/99; 269/152; 269/253

[58] Field of Search ..... 269/88, 81, 91, 94, 269/99-100, 152, 139, 243, 253, 283; 144/286 R, 286 A

[56] References Cited

U.S. PATENT DOCUMENTS

| | | | |
|---|---|---|---|
| 2,466,518 | 4/1949 | Wagner | 269/91 |
| 3,858,864 | 1/1975 | Waldow | 269/152 |
| 4,002,328 | 1/1977 | Wolf et al. | 269/243 |

*Primary Examiner*—Robert C. Watson

*Attorney, Agent, or Firm*—John A. Hamilton

[57] ABSTRACT

A bench vise consisting of a table having a planar top including a depending vertical planar apron along its forward edge, the apron forming a fixed vise jaw, a movable jaw fixture including a planar movable vise jaw, and brackets for supporting the fixture selectively either in a position with the movable jaw confronting the apron jaw, in parallel relation thereto, or in a position above and parallel to the table top, so that the table top serves as a fixed vise jaw.

9 Claims, 8 Drawing Figures

BENCH VISE

This invention relates to new and useful improvements in bench vises for holding work pieces while various operations are performed thereon, such as sawing, planing, edging, boring and the like.

The principal object of the present invention is the provision of a bench vise which can operate selectively either horizontally or vertically. That is, the jaws may open and close either horizontally or vertically, for greater accessability of a work piece for the operation to be performed thereon, as dictated by the size and shape of the work piece itself, and by the nature of the operation to be performed.

Generally, this object is accomplished by the provision of a floor-standing table having a planar table top with a vertical apron depending from the forward edge thereof, either the table top or the apron being adapted to serve as a fixed vise jaw, a movable jaw fixture carrying a planar jaw for movement normal to the plane of said jaw, and two pairs of mounting brackets for securing said movable jaw fixture to said table, one pair of brackets supporting the movable jaw in a vertical plane parallel to and outwardly of the table apron, for movement toward and from said apron, and the other pair of brackets supporting the movable jaw in a horizontal plane parallel to and upwardly from said table top, for movement toward and from said table top.

Another object is the provision of a bench vise of the character described wherein the bracket pair supporting said movable jaw for cooperation with said table apron additionally includes vertically adjustable cradles for supporting the lower edge of a work piece preparatory to clamping it between the vertical vise jaws. The vise is particularly suited for holding large, heavy and cumbersome work pieces, and the cradles are a valuable aid in supporting such work pieces accurately before the jaws are closed. No such cradles are required when the movable jaw is positioned to cooperate with the table top, since the work piece is in that case normally supported by the table top before the jaws are closed, resting thereon by gravity.

Other objects are simplicity and economy of structure, and efficiency and dependability of operation.

Figure 1:
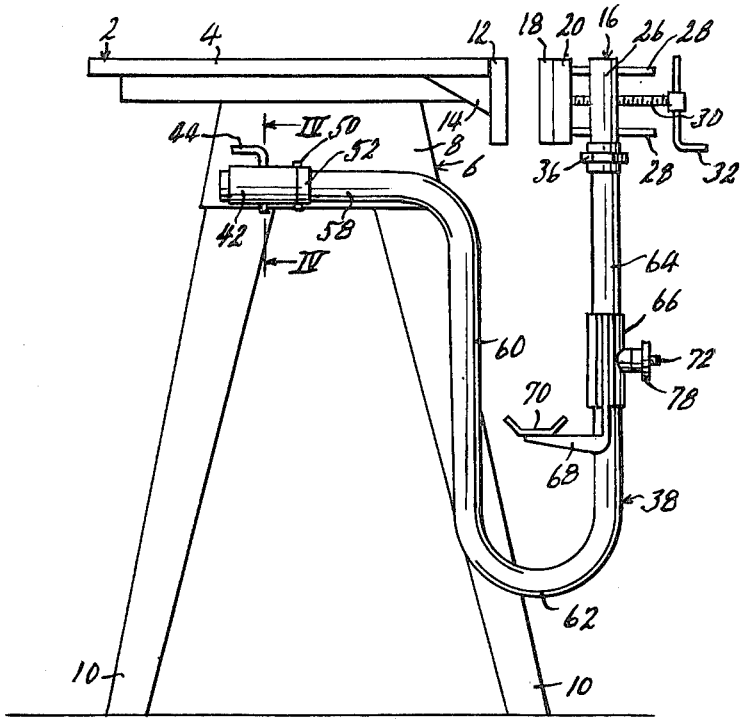
Figure 2:
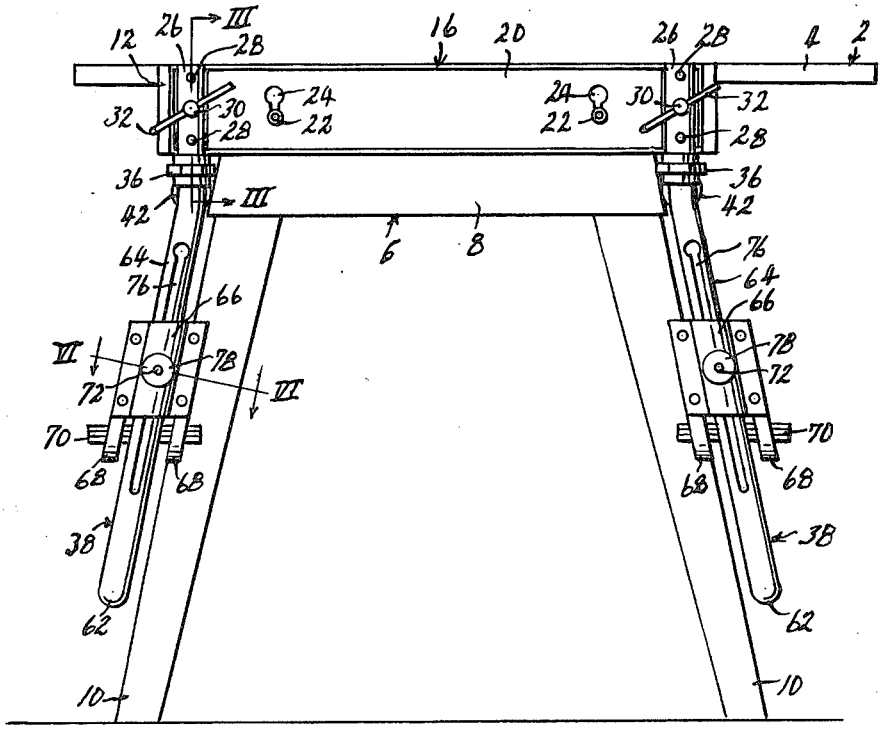
Figure 3:
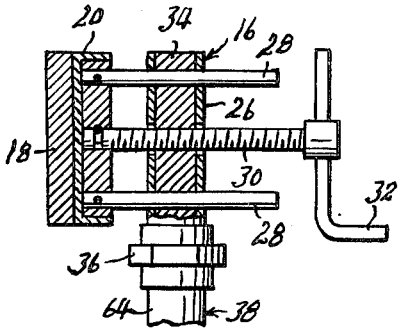
Figure 4:
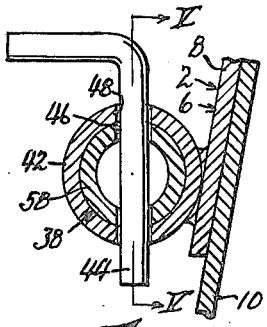
Figure 6:
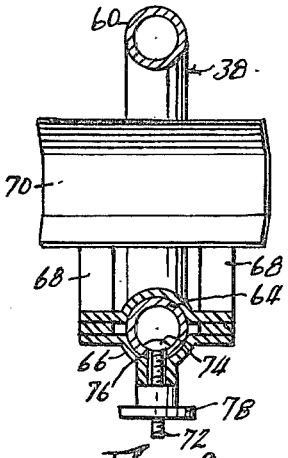
Figure 5:
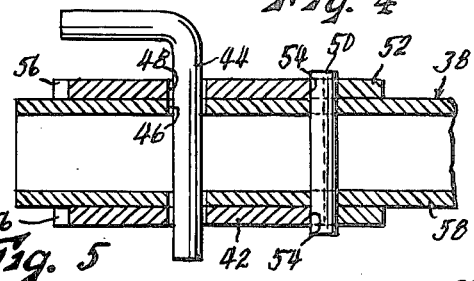
Figure 7:
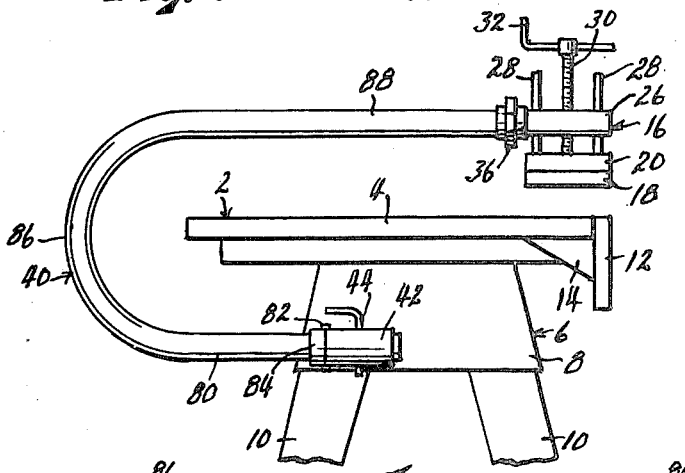
Figure 8:
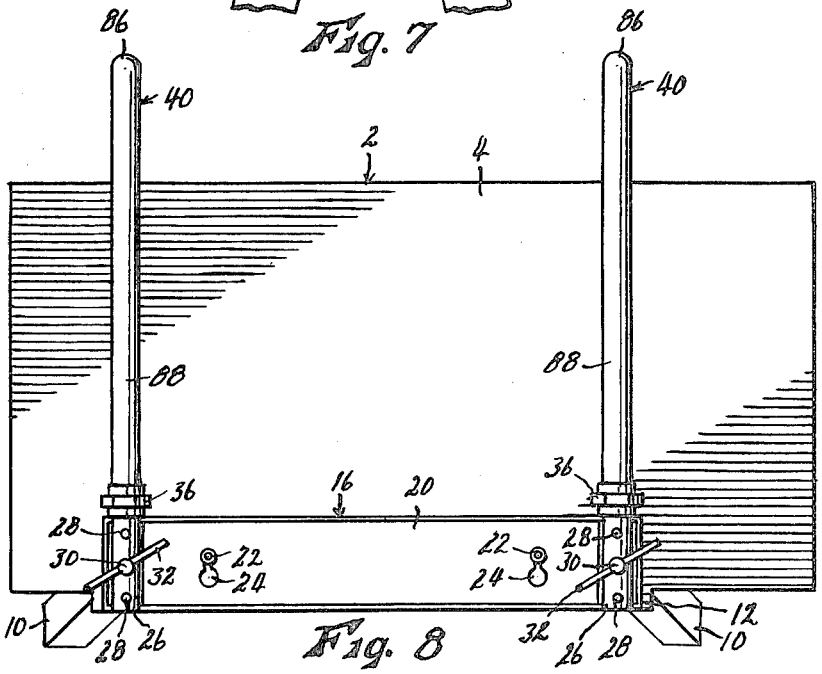

With these objects in view, as well as other objects which will appear in the course of the specification, reference will be had to the accompanying drawing, wherein:

FIG. 1 is a side elevational view of a bench vise embodying the present invention, set up for use as a horizontal vise in that the relative movement of the jaws is horizontal and the confronting jaw faces are vertical, FIG. 2 is a front elevational view of the vise as shown in FIG. 1, FIG. 3 is an enlarged, fragmentary sectional view taken on line III—III of FIG. 2, FIG. 4 is an enlarged, fragmentary sectional view taken on line IV—IV of FIG. 1, FIG. 5 is a fragmentary sectional view taken on line V—V of FIG. 4, FIG. 6 is an enlarged sectional view taken on line VI—VI of FIG. 2, FIG. 7 is a fragmentary view similar to FIG. 1, but set up for use as a vertical vise in that the relative movement of the jaws is vertical and the confronting jaw faces are horizontal, and FIG. 8 is a top plan view of the device as shown in FIG. 7.

Like reference numerals apply to similar parts throughout the several views, and the numeral 2 applies generally to a table consisting of a planar horizontal table top 4 supported by a table base 6 which is rectangular and of reduced dimensions as compared to the table top, being rectangular and having a downwardly and outwardly inclined wall 8 at each of its four sides, and a floor-engaging leg 10 secured in each corner thereof. Said legs are downwardly divergent to provide better stability for the table. Along its forward edge, table top 4 is provided with a depending apron 12, the outer surface of which is planar and vertical, and which is rigidly braced relative to the table top by angle braces 14 (see FIGS. 1 and 7). Both table top 4 and apron 12 are adapted to serve as the fixed jaw of a vise jaw combination, although not at the same time, as will presently appear.

A movable jaw fixture is indicated generally by the numeral 16. It includes a planar rectangular jaw 18, formed preferably of wood, secured by any suitable means to a coextensive steel backing plate 20. As shown, said jaw has headed lugs 22 fixed therein at spaced apart points, the heads of said lugs being inserted through the larger ends of keyhole slots 24 formed in the backing plate, the jaw then being moved slidably over the backing plate to move the necks of said lugs into the narrower ends of said keyhole slots. Fixture 16 also includes a pair of short parallel pipes 26 extending across the minor dimensions of the backing plate adjacent its ends in spaced apart relation from said backing plate, and parallel to the face of jaw 18. Fixed in the outer face of the backing plate, in connection with each pipe 26, are a pair of parallel slide rods 28 disposed normally to the jaw face, and projecting transversely through pipe 26 in sliding relation thereto. A screw 30 parallel to rods 28 and disposed therebetween, is rotatably secured at one end in plate 20, projects transversely through the associated pipe 26, being threaded therein, and is provided at its opposite end with a manually operable crank 32. Each pipe length 26 may be provided with a solid core 34, as shown in FIG. 3, whereby to provide longer slide bearings for rods 28, and a longer thread engagement for screw 30. Also, pipes 26 are each provided, at corresponding ends thereof, with one end portion of an ordinary pipe coupling 36, for attaching the fixture to the mounting brackets presently to be described.

Movable jaw fixture 16 may be selectively mounted on table 2 in either of two positions, a first position as in FIGS. 1-6 in which jaw 18 confronts apron 12 in parallel, forwardly spaced relation thereto, or a second position as shown in FIGS. 7-8 wherein jaw 18 faces downwardly in confronting relation to the forward edge portion of table top 4, in parallel, upwardly spaced apart relation thereto. It is mounted in said first position by a pair of brackets each designated generally by the numeral 38, and in said second position by a pair of brackets each designated generally by the numeral 40, said bracket pairs being interchangeably mountable in a pair of sleeves 42 affixed respectively to the side walls 8 of table base 6, beneath the level of table top 4. Said sleeves are horizontal, extend from front to rear relative to the table, and are welded to the respective side walls 8.

Each of brackets 38 consists of a length of pipe, the rearward end portion of which is inserted slidably and rearwardly into the associated sleeve 42, and fixed therein by an assembly pin 44 inserted transversely through matching holes 46 and 48 formed therein (see FIGS. 4 and 5). To assist in aligning said holes for easy insertion of said assembly pin, an alignment pin 50 is affixed transversely in the bracket pipe, extending outwardly from both sides thereof and reinforced by a collar 52 also welded to the pipe, pin 50 being laterally engageable in a diametrical notch 54 formed in the forward end of sleeve 42, whereby the bracket 38 is properly angularly aligned in the sleeve, and holes 46 and 48 are aligned for easy insertion of pin 44. Diametrical notches 56 are also formed in the rearward end of sleeve 42, to accomodate bracket 40, as will presently appear.

The leg 58 of bracket 38 engaged in sleeve 42 extends forwardly therefrom, is bent downwardly just rearwardly of apron 12 to form a generally vertical leg 60, then rebent forwardly and upwardly as indicated at 62 to form a second generally vertical leg 64 spaced forwardly of apron 12, the other half of the pipe coupling 36 of one of fixture pipes 26 being affixed to the upper end of leg 64, whereby the movable jaw fixture 16 may be firmly mounted on the two brackets 38. The space between legs 60 and 64 of brackets 38 forms a throat for accomodating the portions of a work piece extending below jaws 12 and 18, when said work piece is clamped between said jaws. The lower portions of each bracket 38 are angled slightly outwardly, as shown in FIG. 2, to accomodate them to the downward divergence of table legs 10.

Carried slidably on the forward leg 64 of each bracket 38 is a sleeve 66 having a pair of rearwardly extending arms 68 to which is affixed an upwardly facing generally horizontal cradle 70 disposed between legs 60 and 64 of the bracket. Said cradles are adapted to support the lower edge of a work piece preparatory to clamping it between jaw 18 and apron 12, which of course is also a jaw, by turning cranks 32 to move jaw 12 toward apron 18. Cradles 70 may be adjusted vertically, to accomodate work pieces having different vertical dimensions, by sliding sleeves 66 along bracket legs 64. Each sleeve 66 may be clamped at any desired elevation on its bracket leg 64 by a clamp bolt 72 having its head 74 disposed within said bracket leg (see FIG. 6) and its shank projecting laterally from said leg through a slot 76 formed longitudinally in said leg, then through a wall of said sleeve, and having a hand-operated nut 78 threaded on its outer end. Loosening of said nuts permits the sleeves to slide freely on bracket legs 64.

Each of brackets 40 also consists of a length of pipe, bent into horizontal U-form as best shown in FIG. 7. It includes a horizontal lower leg 80 insertable forwardly into the associated sleeve 42 and securable therein by assembly pin 44, and having an aligning pin 82 and collar 84 corresponding to pin 50 and collar 52 of bracket 38, pin 82 being engageable in notches 56 at the rearward end of sleeve 42. At the rearward end of leg 80, the bracket pipe is rebent upwardly and forwardly around the rearward edge of table top 4, as indicated at 86, to provide a horizontal leg 88 extending forwardly over the table top, each leg 88 having affixed to its forward end the mating half of the pipe couplings 36 of pipes 26 of jaw fixture 16. Brackets 40 are of such dimensions that when movable jaw fixture 16 is mounted thereon as shown in FIGS. 7 and 8, movable jaw 18 will be disposed in parallel, upwardly spaced relation from the forward edge portion of table top 4, as shown.

Operation of the vise is believed to be amply apparent from the foregoing description of its construction. Work pieces may be alternatively clamped between cooperating jaws either by horizontal relative movement of said jaws, as best exemplified in FIG. 1, or by vertical relative movement of said jaws, as best exemplified in FIG. 7. The same movable jaw fixture 16 is utilized in both usages, the change requiring only the interchanging of relatively simple sets of mounting brackets. The advantages of this choice of horizontal or vertical jaw action in accomodating the vise to work pieces of different configurations, and in supporting the work pieces in the most convenient positions and attitudes for the operations to be performed thereon, are considered to be obvious.

While I have shown and described a specific embodiment of my invention, it will be readily apparent that many minor changes of structure and operation could be made without departing from the spirit of the invention.

What I claim as new and desire to protect by Letters Patent is:

1. A bench vise operable to provide either horizontal jaw action or vertical jaw action alternatively, said bench vise comprising:

a. A floor-supported table having a horizontal planar table top and a vertical planar apron depending from the forward edge of said table top, both said table top and said apron each being capable of serving as the fixed jaw of a vise jaw combination, b. a movable jaw fixture including mounting portions, a planar movable jaw carried by said mounting portions, said movable jaw being generally rectangular and horizontally elongated, said mounting portions including a pair of short pipes extending parallel to the plane of said movable jaw and to the minor dimension of said jaw, respectively adjacent the opposite narrower ends thereof, and manually operable screw means for moving said jaw laterally of said short pipes, and c. a pair of alternatively usable sets of brackets each adapted to support the mounting portions of said movable jaw fixture with the plane of said movable jaw disposed parallel to and outwardly from said apron, and the second of said sets of brackets supporting said fixture with the plane of said movable jaw disposed parallel to and upwardly from said table top, each of said bracket sets comprising a pair of longer pipes, means detachably affixing one end of each of said longer pipes to said table beneath the level of said table top, and a pipe coupling detachably connecting the opposite end of each of said longer pipes to one of the short pipes of said movable jaw fixture.

2. A bench vise as recited in claim 1 wherein said movable jaw is connected to each of the short pipes of said fixture by means comprising:

a. a screw rotatably connected at one end to said jaw, extending normally to the plane of said jaw and being threaded laterally through said short pipe, and b. a manually operable crank affixed to the opposite end of said screw.

3. A bench vise as recited in claim 2 with the addition of:

a. a pair of spaced apart parallel slide rods each affixed at one end to said movable jaw in association with each of said screws, and extending therefrom in parallel relation to said screw, said slide rods extending slidably and laterally through the associated short pipe.

4. A bench vise as recited in claim 1 wherein said means for attaching one end of each of said longer bracket pipes to said table comprises:

a. a horizontal tubular sleeve affixed to said table in association with each of said longer bracket pipes, beneath the level of said table top, and into which an end portion of said longer pipe may be slidably inserted, and b. an assembly pin insertable transversely through matching holes of said sleeve and said pipe.

5. A bench vise as recited in claim 4 with the addition of an aligning pin fixed transversely in said longer pipe adjacent an end of said sleeve and engaging in matching diametrical notches formed in said sleeve end, whereby said matching holes are aligned for insertion of said assembly pin.

6. A bench vise as recited in claim 1 wherein each of said longer pipes of said first set of brackets extends forwardly from its point of attachment to said table, then downwardly and upwardly in a vertical U-bend, and finally secured to said movable jaw fixture, said U-bends forming a throat for accomodating work pieces to be clamped between said movable jaw and said apron.

7. A bench vise as recited in claim 6 with the addition of an upwardly facing cradle carried by each of the longer pipes of said first set of brackets and disposed within the U-bend of said pipe, whereby to support the lower edge of a work piece to be clamped between said movable jaw and said apron.

8. A bench vise as recited in claim 7 wherein each of said cradles is attached to the associated bracket pipe by means operable to permit vertical adjustment of said cradle relative to said movable jaw.

9. A bench vise as recited in claim 1 wherein each of said longer pipes of said second set of brackets extends rearwardly from its point of attachment to said table, and is formed in a horizontal U-bend curving upwardly and forwardly around the rearward edge of said table top and extending forwardly over said table top for attachment at their forward ends to said movable jaw fixture.

* * * * *